United States Patent [19]

Loafman

[11] 4,194,736

[45] Mar. 25, 1980

[54] BOWLING AID DEVICE

[76] Inventor: James R. Loafman, 3420 Rolling La., Midwest City, Okla. 73110

[21] Appl. No.: 848,949

[22] Filed: Nov. 7, 1977

[51] Int. Cl.[2] ..... A63B 69/00

[52] U.S. Cl. ..... 273/54 B; 2/21; 128/87 A

[58] Field of Search ..... 273/54 B, 189 A; 2/21; 128/87 A; 294/25

[56] References Cited

U.S. PATENT DOCUMENTS

| | | | |
|---|---|---|---|
| 1,617,942 | 2/1927 | Foulke | 128/87 A |
| 1,837,691 | 12/1921 | Thigpen | 128/87 A |
| 2,273,028 | 2/1942 | Eaton | 128/87 A |
| 2,847,005 | 8/1958 | Bourne | 2/21 X |
| 3,408,077 | 10/1968 | Norwood | 273/189 A |
| 3,563,545 | 2/1971 | Rasche | 273/54 B |

*Primary Examiner*—Anton O. Oechsle
*Attorney, Agent, or Firm*—William R. Laney

[57] ABSTRACT

A device for aiding a bowler in delivering a bowling ball comprising a finger sleeve including opposed wings mutually engageable in a generally cylindrical configuration for encirclement of the little finger of the bowler. The finger sleeve has a bracing element secured thereto. The bracing element includes an elongated rib secured to the finger sleeve between the opposed wings, and a palm extension which projects from the rib and finger sleeve a distance which is from about one-half to about three-fourths the length of the elongated rib.

10 Claims, 5 Drawing Figures

BOWLING AID DEVICE

BACKGROUND OF THE INVENTION

Brief Description of the Prior Art

Bowling is a popular and widely practiced sport which, to be performed with superior skill, requires very close control of the bowling ball at the time of delivery by means of the arm and the hand by which the ball is gripped. It is necessary in delivering the bowling ball to assure that the ball is released at precisely the right point at the beginning of the alley, and has a proper degree of spin in the proper direction applied thereto in order that it will be most effective in striking critical pins in the pin grouping and, through the spin on the ball, will impart the most effective action to the pins struck by the ball, and those in turn struck by falling pins.

For the purpose of enabling the bowler to more effectively deliver the ball, and more specifically, to achieve the right hand and finger sensitivity, surface contact and grip upon the ball at the time that it is delivered, a number of devices have been proposed for wearing on the hand or wrist at the time of delivering the bowling ball which are claimed by some to permit a more effective and controlled delivery and release of the ball. Such devices have ranged from flexible sheaths into which the fingers are inserted and which cover most of the hand, to straps, rings and other devices placed on one or more fingers to prevent spreading of the fingers, or to interconnect the fingers in some way so as to assure that they remain in an optimized position on the bowling ball at the time of delivery.

One of the more recent proposals in devices of the type under discussion is the bowler's lift ring illustrated and described in De Mire U.S. Pat. No. 3,091,455. The De Mire lift ring is a ring of flexible material which is intended to be placed upon one of the fingers of the bowling hand. Such a ring is provided with a resilient body extending around the finger and having a bottom surface which is especially adapted for cooperative surface engagement with the bowling ball. The lift ring so provided enables the ball to be more easily released, and reduces the fatigue otherwise tending to occur in the finger over extended periods of bowling. The lift ring of De Mire has an axial dimension long enough to permit it to bridge across one joint of a finger on which it is used, but too short to provide any bracing or bridging action across more than one joint of the finger. Moreover, the sizing of the ring must be such, as it is constructed, that it will fit upon the particular finger of a specific bowler who is to use the ring, and is not adaptable to be used on other fingers or on the hands of different bowlers.

BRIEF DESCRIPTION OF THE PRESENT INVENTION

The present invention comprises a device for aiding a bowler in delivering a bowling ball, which device can be very easily used in a way which will enable the bowler to improve his score through control of the manner in which the little finger of the bowler contacts and cooperates with the bowling ball during delivery of the ball, and particularly, at the instant of release.

Broadly described, the bowling aid device of the present invention comprises a finger sleeve of flexible material which is characterized in having opposed wings which can be folded about and engaged with each other to form the tube or ring encircling the little finger of the bowler, and relatively firmly retained thereon. A bracing element is secured to the finger sleeve and includes an elongated rib which projects centrally along the sleeve between the opposed wings in a position to extend along the lower side of the bowler's little finger when the device is placed on the little finger. The rib is formed integrally with a palm extension which projects from one side of the rib for a distance which is from about one-third to about three-fourths the axial length of the elongated rib. The palm extension terminates at a location such that it will be just below or aligned with the first joint of the little finger which is, of course, the location at which the heart line is located in the palm of the bowler's hand. In a preferred embodiment of the invention, the flexible finger sleeve includes a tongue which projects over, and is secured to, the palm extension, and is formed integrally with the opposed wings of the finger sleeve.

In use, the bowling aid device of the invention is utilized by first fitting the finger sleeve snugly, but comfortably, around the little finger of the bowling hand, which fitting can be easily accomplished by reason of the adjustability of the diametric size of the finger sleeve when it is closed into its tubular shape. The finger sleeve is placed on the bowler's little finger so that the elongated rib of the bracing element extends along the underside of the bowler's finger and bridges across the two outer joints of the little finger. The palm extension is then caused to extend between the place where the little finger joins the palm and about the heart line of the palm, which is where the first joint of the little finger actually lies within the hand. In this position, the little finger, while it can flex slightly, is prevented from curling or "knuckling under" at the time of delivery of the bowling ball, a pronounced, near-autonomic tendency, particularly after the bowler has been at the game for some time. The prevention of curling or knuckling under of the little finger enables it to remain in its control position on the bowling ball, and prevents such curling under from preventing proper release and development of proper spin on the ball at the time that it is delivered.

An important object of the present invention is to provide a bowling aid device which is very economical in construction and cost, can be easily used by any bowler, and which, in almost every instance, will enable the bowler to improve his game by better control of the ball during delivery and release.

A further object of the invention is to provide a bowling aid device which is aesthetic in its construction and appearance and can be quickly made to fit upon the little finger of the bowling hand of any bowler by reason of adjustability in the size of the device.

An additional object of the invention is to provide a finger-worn device for aiding bowlers in delivering the bowling ball, which device is comfortable to wear and does not cause sweating of the finger or portion of the palm with which it is in contact.

Additional objects and advantages of the invention will become apparent from the following detailed description of a preferred embodiment of the invention when such description is read in conjunction with the accompanying drawings which illustrate such preferred embodiment.

BROAD DESCRIPTION OF THE DRAWINGS

DETAILED DESCRIPTION OF A PREFERRED EMBODIMENT OF THE INVENTION

Figure 1:
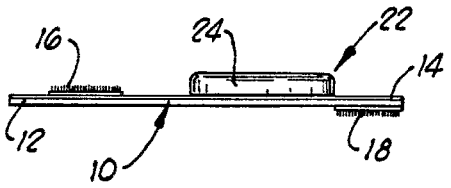
FIG. 1 is a side elevation view of a bowling aid device constructed in accordance with the present invention.
Figure 2:
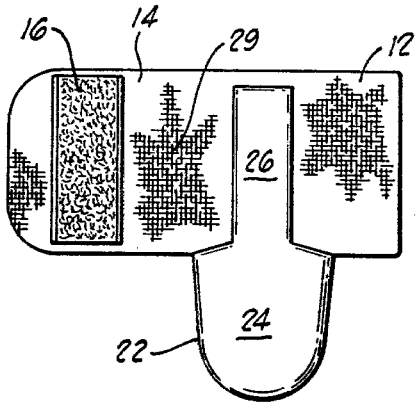
FIG. 2 is a bottom plan view of the bowling aid device.
Figure 3:
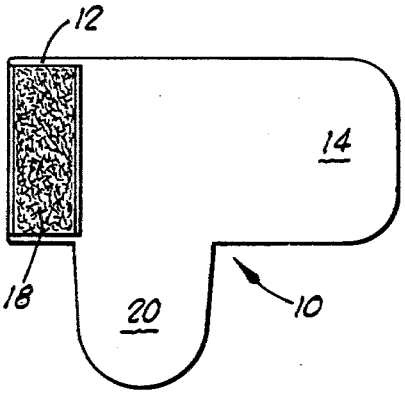
FIG. 3 is a top plan view of the bowling aid device.

Referring initially to FIG. 1 of the drawings, shown therein is the bowling aid device of the invention, which device includes a finger sleeve element designated generally by reference numeral 10. The finger sleeve element 10 is generally rectangular in configuration and includes a pair of opposed wings 12 and 14 as shown in FIGS. 2 and 3. A pair of cooperating mutually engageable securement strips 16 and 18 are placed in oppositely facing directions on opposite sides of the wings 12 and 14, respectively. The securement strips 16 and 18 can suitably be of VELCRO material having hooks and loops of conventional construction, and functioning in a manner well known in the art. In the illustrated embodiment of the invention, the finger sleeve element 10 further includes a laterally projecting tongue portion 20 which extends from one side of the central portion of the finger sleeve element, and is preferably formed integrally with the opposed wings 12 and 14.

A bracing element, designated generally by reference numeral 22, includes an enlarged palm contacting portion 24 which underlies and registers with the tongue portion 20 of the finger sleeve. Formed integrally with the palm contacting portion 24, and constituting a part of the bracing element 22, is an elongated rib 26 which extends a major portion of the total distance across the transverse width of the finger sleeve, and is secured to the finger sleeve at a location between the opposed wings 12 and 14. The length of the elongated rib 26 is selected to be such that it will extend from the commencement of the little finger of the hand at the location where this digital member is joined to the palm, and extend out sufficiently far to bridge across the two outer joints of the little finger. The elongated rib 26 will generally be made from about one and one-fourth inches to two and one-fourth inches in length. It is preferred that the palm contacting portion 24 of the bracing element 22 has a distance of projection from the elongated rib 26 which is from about one-half to about three-fourths of the length of the elongated rib. In any event, the palm contacting portion should be sized so that it extends only to about the location of the first joint of the little finger which can also be described as to a location adjacent, but not crossing the heart line in the palm of the hand.

The finger sleeve element 10 is constructed of a relatively soft and flexible material of leather-like quality, such as natural or artificial leather and is capable of being easily wrapped around and conformed to the generally cylindrical outer configuration of the little finger. In the illustrated preferred embodiment of the invention, the leather is backed by an open mesh layer of fabric (29 in FIG. 2), and has a thickness of from about one-sixteenth inch to about one-eighth inch.

The bracing element 22 is constructed of a relatively stiff elastomeric material which, though it can be flexed to some extent, has an elastic memory tending to restore it to its original monoplanar shape, and which is capable of resisting flexing or curling of the little finger. The stiffness of the elastomer of which the bracing element 22 is constructed, however, should not be such that some slight bending by the little finger sufficient to permit it to conform to the curvature of a bowling ball cannot be realized. The bracing element preferably has a thickness of from about one-eighth inch to about one-quarter inch.

Figure 4:
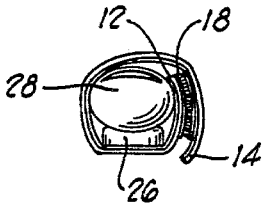
FIG. 4 is a view in elevation looking toward the end of the little finger upon which the bowling aid device of the invention has been placed.
Figure 5:
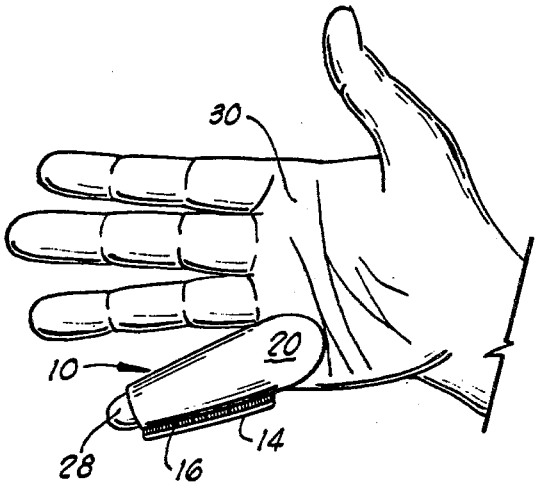
FIG. 5 is a palm side view of the bowling hand of a bowler, showing the appearance of the bowling aid device of the invention when it has been placed in position for use on the little finger of the bowler.

The bowling aid device, in use, is placed upon the little finger 28 of the bowler to attain the configuration shown in FIGS. 4 and 5. This is accomplished by wrapping the opposed wings 12 and 14 of the finger sleeve element 10 into a generally cylindrical configuration so that the wings overlap to the extent that the securement strips 16 and 18 can be engaged through contact with each other. It will be perceived that the finger sleeve element 10 is adjustable so that it can be made to fit substantially any size finger. When it is placed in proper position, the bracing element 22, and more specifically, the elongated rib 26 thereof, extends along the underside of the little finger 28 and bridges across the two outer joints of the little finger. The elongated palm contacting portion 24 lies in the outer portion of the palm 30 of the bowling hand and extends inwardly to a location which is even with the first joint of the little finger. This location will be perceived by reference to FIG. 5 when it is recalled that the enlarged, palm contacting portion 24 of the bracing element 22 lies on the other side of, and is in registry with, the tongue portion 20 of the finger sleeve element 10.

The effect of use of the bowling aid device of the invention is to permit the bowler to very precisely control and release the bowling ball so that more effective striking of the pins is achieved. It has been my observation that the tendency of the little finger to curl or to shift position during the approach and particularly, at the time of release of the ball, prevents precise and consistent control of the manner in which the bowling ball is released each time it is delivered. This is particularly true because at times, fatigue, tension and other factors may cause the little finger to curl at the instant of, or just before, delivery more than at other times. Moreover, the extent to which the little finger exerts pressure on the ball during the approach may vary from delivery to delivery, and cause differences in the way in which the ball is released, and particularly the amount of spin imparted thereto.

Through the use of the bowling aid device of this invention, the little finger of the bowling hand is permitted to bend enough that contact can be had with the curved surface of the bowling ball during gripping of the ball, approach and delivery, but curling or "knuckling under" of the little finger is completely prevented. Moreover, I have found that the wearing of the bowling aid device of the invention during extended bowling periods does not cause fatique, and does not cause sweating at the location where it is used. A number of experiments have clearly shown that the use of the device enables the bowler of some experience to be more consistent and to improve his score.

Although a preferred embodiment of the invention has been herein described, it will be understood that various changes and modifications in the described and illustrated structure can be effected without departure from the basic principles which underlie the invention. Changes and innovations of this type are therefore deemed to be circumscribed by the spirit and scope of the present invention, except as the same way may be necessarily limited by the appended claims of reasonable equivalents thereof.

What is claimed is:

1. A device for aiding bowlers comprising:

a flexible finger sleeve including a pair of opposed, spaced wings and sized for encircling the little finger of the bowling hand with the wings overlapped;

means on said wings for adjustably engaging said wings in overlapped relation to each other; and an elastomeric bracing element secured to one side of said finger sleeve between said wings and including:

an elongated rib having a length of from one and one-fourth inches to two and one-fourth inches to extend across the two outer joints of the little finger of the bowling hand; and a palm contacting portion projecting from said elongated rib at one end thereof by a distance which is from about one-half to about three-fourths the length of said elongated rib.

2. A device as defined in claim 1 wherein said rib and palm contacting portion each have a thickness of from about one-eighth inch to about one-quarter inch.

3. A device as defined in claim 1 wherein said flexible finger sleeve is constructed of a material selected from the group consisting of leather and artifical leather having a thickness of from about one-sixteenth inch to about one-eighth inch.

4. A device as defined in claim 1 wherein said means on said wings for adjustably engaging said wings comprises:

a first securement strip secured to one of said opposed wings; and a second securement strip secured to the other of said opposed wings and engageable on contact with said first securement strip, said securement strips being dimensioned to substantially overlap each other when said wings overlap and encircle the little finger of the bowling hand.

5. A device as defined in claim 1 wherein said finger sleeve in its non-finger-encircling relaxed status is a generally rectangular panel.

6. A device for aiding bowlers comprising:

a flexible finger sleeve including a pair of opposed, spaced wings and sized for encircling the little finger of the bowling hand with the wings overlapped;

means on said wings for adjustably engaging said wings in overlapped relation to each other;

a resilient bracing element secured to one side of said finger sleeve between said wings and including:

an elongated rib having a length of from one and one-fourth inches to two and one-fourth inches to extend across the two outer joints of the little finger of the bowling hand; and a palm-contacting portion projecting from said elongated rib at one end thereof by a distance which is from about one-half to about three-fourths the length of said elongated rib; and said finger sleeve further including an integrally formed tongue portion over, registering with and bonded to said palm-contacting portion.

7. A device as defined in claim 6 wherein said rib and palm contacting portions each have a thickness of from about one-eighth inch to about one-quarter inch.

8. A device as defined in claim 7 wherein said rib is an elastomeric material flexible in response to bending pressure from the little finger of the bowling hand to conform to the curvature of a bowling ball.

9. A device as defined in claim 8 wherein said means on said wings for adjustably engaging said wings comprises:

a first securement strip including locking loops and secured to one of said opposed wings; and a second securement strip secured to the other of said opposed wings and having locking hooks engageable with said loops upon contact with said first securement strip, said securement strips being dimensioned to substantially overlap each other when said wings overlap and encircle the little finger of the bowling hand whereby the size of a finger encircled by the overlapped wings can be adjustably accommodated.

10. A device for aiding bowlers comprising:

a flexible finger sleeve including a pair of opposed, spaced wings and sized for encircling the little finger of the bowling hand with the wings overlapped;

means on said wings for adjustably engaging said wings in overlapped relation to each other; and a resilient bracing element secured to one side of said finger sleeve between said wings and including:

an elongated rib having a length of from one and one-fourth inches to two and one-fourth inches to extend across the two outer joints of the little finger of the bowling hand, said rib being an elastomeric material which is flexible in response to bending pressure from the little finger of the bowling hand to conform to the curvature of a bowling ball; and a palm-contacting portion projecting from said elongated rib at one end thereof by a distance which is from about one-half to about three-fourths of the length of said elongated rib.

* * * * *